United States Patent [19]

Ketchum

[11] 4,258,924

[45] Mar. 31, 1981

[54] SOCCER TRAINING APPARATUS

[76] Inventor: John L. Ketchum, 3200 SW. 94th Pl., Miami, Fla. 33165

[21] Appl. No.: 61,853

[22] Filed: Jul. 30, 1979

[51] Int. Cl.[3] ..... A63B 71/02; A63B 63/00; A63B 69/00

[52] U.S. Cl. ..... 273/411; 273/392; 273/395

[58] Field of Search ..... 273/55 R, 181 J, 181 K, 273/411, 26 A, 392, 394, 395, 410, 407, 29 A; 272/65, 76

[56] References Cited

U.S. PATENT DOCUMENTS

| | | | |
|---|---|---|---|
| 2,247,501 | 7/1941 | Jenks et al. | 273/181 J |
| 2,558,081 | 6/1951 | Gardenhour | 273/55 R |
| 2,879,996 | 3/1959 | Lederer | 273/195 B X |
| 3,206,196 | 9/1965 | Jackson | 273/26 A |
| 3,508,752 | 4/1970 | Lemon | 273/407 X |

*Primary Examiner*—George J. Marlo
*Attorney, Agent, or Firm*—Gustave Miller

[57] ABSTRACT

The soccer training apparatus consists of a rebounding wall which is about four by eight feet. The wall in turn is yieldably mounted on a rectangular support frame, which frame may be mounted on a usual field sled or any suitable base. Two support rollers are mounted below the wall to track along the support sled, or shelf, if preferred. Tension control of the rebounding surface is accomplished by six control bolts which are ball and socket mounted on the reverse or back side of the rebounding wall and pass through enlarged apertures in the support frame. Suitable compressible springs are mounted about the control bolts and positioned between the rebounding wall and the support frame. The final control of the rebounding surface is accomplished by manually adjustable nuts threaded on the protruding ends of the control bolts. The ends of the control bolts are attached to the back of the rebounding wall in sockets secured thereto, which permit a few degrees of canting or tilting that can occur when the ball strikes the surface at various angles and positions.

In addition, two or more practice walls can be joined together, in flexible relation to each other, by passing a pair of bolts through two adjacent spaced apart frames with a yieldable spacer sleeve about each of the bolts.

2 Claims, 6 Drawing Figures

SOCCER TRAINING APPARATUS

BACKGROUND OF THE INVENTION

Soccer has become a most popular sport throughout the U.S. over the past decade. Young players' leagues commence in the elementary school years, both as in-school and out-of-school organizations. However, as the popularity of the sport has grown, so have the lamentations of the coaches as to the lack of adequate training space and training devices. Daily, coaches are faced with surmounting these two problems. Even when field space is provided, there is seldom a facility nearby with suitable structures to serve as training walls. Most generally, soccer finds itself competing for wall space with tennis, handball, racquet ball and even jai alai enthusiasts. Consequently, even adequate wall areas which might allow young players the opportunity of practicing on an individual basis are often at a premium. However, even when such facilities are available, weather conditions may become a factor. Under inclement conditions, the soccer player is now frequently faced with the need to seek space in a gymnasium, where competition is even greater than it was in the open field.

OBJECTS OF THE INVENTION

It is therefore the object of this invention to provide the sport of soccer with a soccer training apparatus suitable for use by both novices and experienced soccer players.

A further object of this invention is to provide a portable practice wall which may be utilized even in considerably limited spacial areas for controlling rebounding velocities.

A further object of this invention is to provide a portable practice wall which will develop the players' reactions and judgments to the approaching ball.

A further object of this invention is to provide a practice wall which is adjustably yieldable so as to cause rebounds at different angles and speeds, so as to develop skills on the part of the players in making head and shoulder plays.

A further object of this invention is to provide a practice wall which will allow players to acquire skill in realistic "goalie" responses and reactions.

A further object of this invention is to provide a soccer practice training apparatus that is an improvement over all previous ball game practice devices, such as shown in U.S. Pat. Nos. 3,840,228; 3,979,120; 4,026,551; 4,036,494; and Soccer Practice Net 4,083,561 and others.

BRIEF DESCRIPTION OF THE FIGURES

With the above and other related objects in view, this invention consists in the details of construction and combination of parts as will be more fully understood from the following description when read in conjunction with the accompanying drawings, in which.

DETAILED DESCRIPTION OF THE INVENTION

Figure 1:
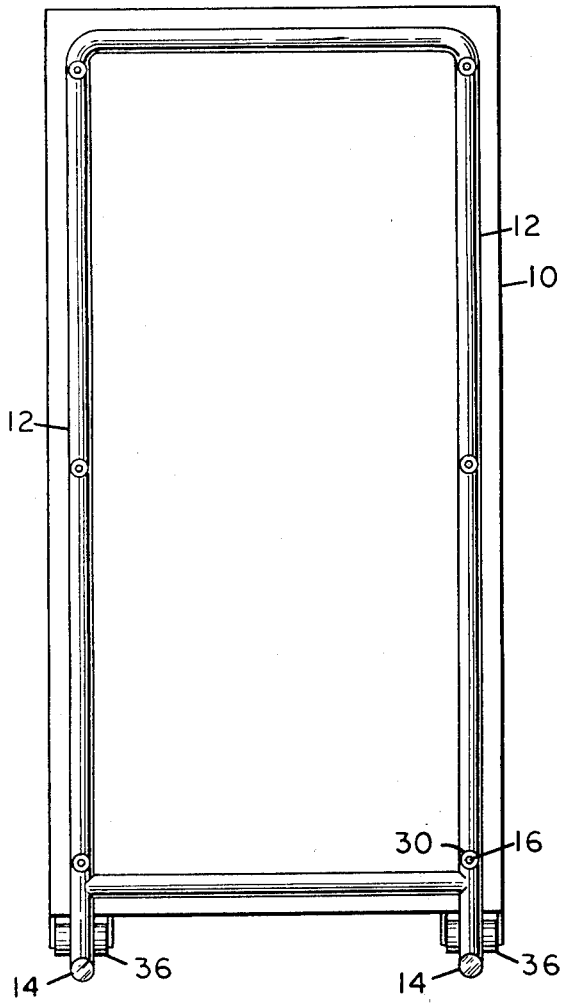
FIG. 1 is an elevational view of the soccer training apparatus of this invention, looking at the back of the wall.
Figure 2:
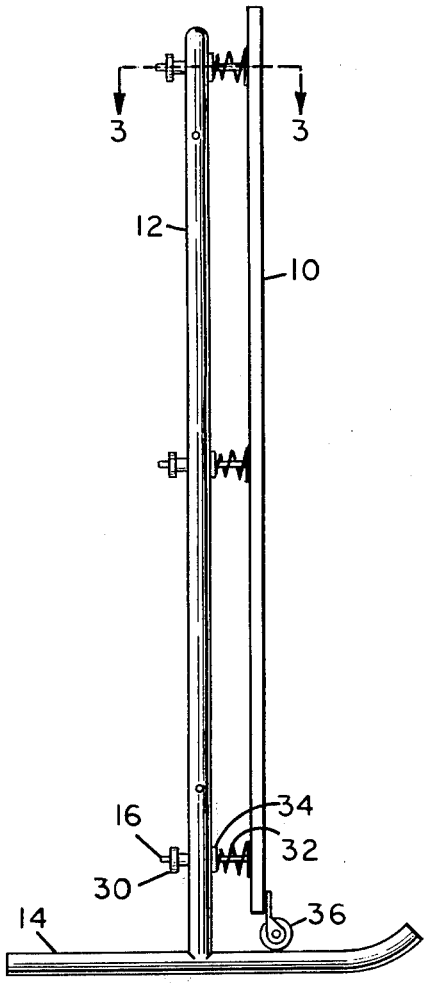
FIG. 2 is a side view of FIG. 1.
Figure 3:
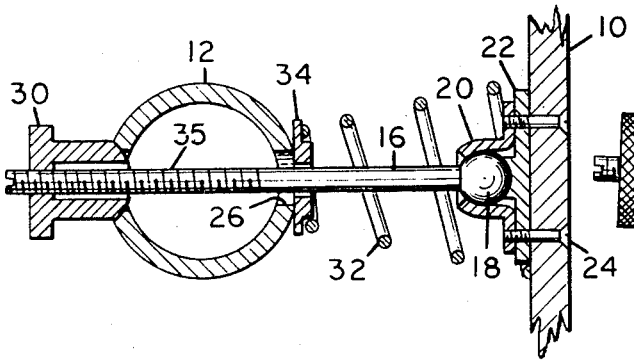
FIG. 3 is a sectional view on line 3—3 of FIG. 2.
Figure 4:
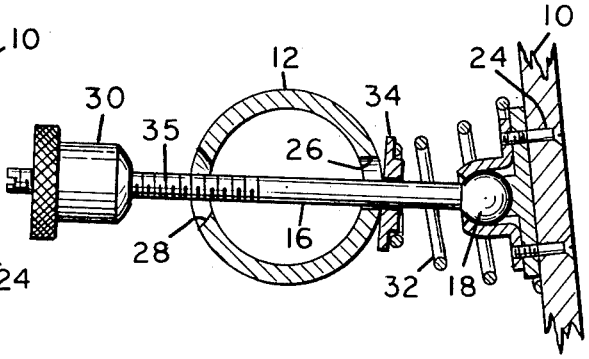
FIG. 4 is a similar view with the spring compressed by a ball hitting the wall at high speed to change the rebound velocity and angle of the ball.

There is shown at 10 a rectangular wall, which in the preferred form is approximately four feet by eight feet, which may have a smooth or irregular surface (not shown). This wall 10 is yieldably secured to a correspondingly shaped frame 12 supported on a conventional portable field sled 14, so that it may be transported readily to any desired location.

The supporting frame 12 is preferably a rectangular member slightly smaller than the wall 10, and, as shown, may be made of piping, although it may obviously be a solid member as is the wall 10.

The wall 10 is adjustably yieldably supported on the frame 12 by six bolts 16, one at each corner, and the others intermediate the corners. Each bolt 16 has a ball 18 integrally connected thereto and rotatably secured in a socket 20 having a socket base 22, the socket 20 and socket base 22 being suitably secured to the back of the wall 10 by suitable means such as screw 24.

The bolts 16 extend through enlarged apertures 26 and 28 in the frame 12, and a hand nut 30 is adjustably threaded on the threads 35 of the bolts 16. A compressible spring 32, preferably tapered, as shown, surrounds the bolt 16 between the socket base 22 and is biased against an offset washer 34 of a diameter larger than the aperture 26 in the frame 12 on the side toward the ball 18 and its socket 20. The hand adjustable nut 30, threaded on bolt 16, can be loosened or tightened on bolt 16 to preset the compression of the spring 32.

At the lower end of each side of frame 10 there is rotatably secured a roller 36 that may ride on the sled 14 and both support the weight of the wall and keep the wall 10 from abutting the sled 14.

Figure 5:
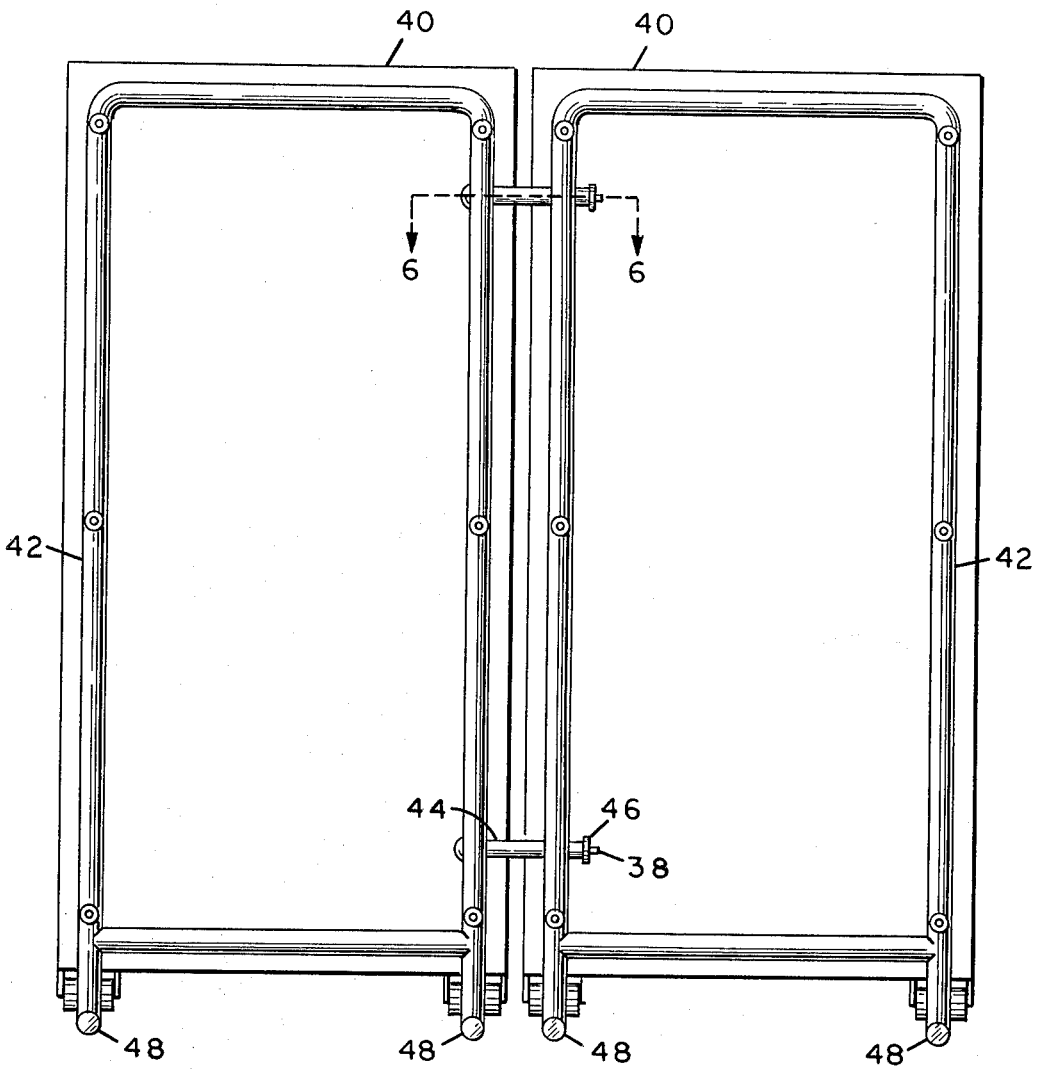
FIG. 5 is a back elevational view showing two walls yieldably secured together to enlarge the wall area.
Figure 6:
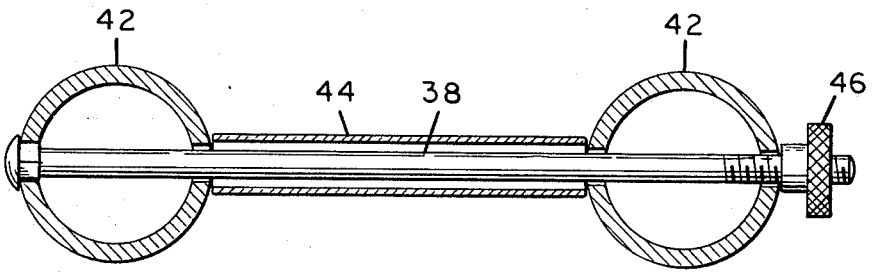
FIG. 6 is a sectional view of the yieldable wall connectors, on line 6—6 of FIG. 5.

As shown in FIGS. 5 and 6, the area of the wall 10 may be increased by yieldably joining up two or more walls 40. This is done by securing two bolts 38 through spaced apart frames 42, each having a wall 40 held in yieldably spaced apart position by a yieldable sleeve 44 about the bolts 38, and each supported on an individual sled 48. The sleeves 44 may be made of heavy rubber hose, and a nut 46 is provided on bolt 38 to tighten the frames 42 against the sleeve 44.

OPERATION OF THE INVENTION

In operation the single wall form, shown in FIGS. 1 to 4, may be used in any suitable location, indoors or outdoors. The flexibility of the wall may be preset by adjusting the hand nuts 30 as desired to compress the springs 32 to adjust the yieldability of the wall 10. The tighter the spring is compressed by the nut 30, the stiffer the wall 10 is, the less it can yield when struck by a soccer ball, and vice versa.

If a larger wall area is desired, two or more walls 40 are yieldably secured together, as shown in FIGS. 5 and 6. If desired one wall 40 may be preset to be more yieldable than another wall 40, thus changing the velocity and angle of rebound of the soccer ball, and thus developing greater skill on the part of the player.

The above described soccer training apparatus has been especially designed to eliminate several currently existing major problems faced by soccer coaches and players. Simultaneously, it provides a new facility in the concept of a portable wall which not only allows it to be placed in various locations but which also possesses a two-dimensional adjustment system which is capable of reducing the amount of training space and time required of such space.

Furthermore, it may be readily stored in any convenient area.

ABSTRACT OF THE DRAWINGS

In the drawings like numbers refer to like parts, and for the purpose of explication, set forth below are the numbered parts of the improved soccer training apparatus of this invention:

10 portable, yieldable wall
12 frame
14 sled
16 bolt holding wall 10 to frame 12
18 ball integral on bolt 16
20 socket for ball 18
22 base for socket 20
24 screw holding socket base 22 to wall 10
26 enlarged bolt aperture on wall side of frame 12
28 enlarged bolt aperture on other side of frame 12
30 hand nut on bolt 16
32 compressible spring
34 offset washer against which spring 32 is biased
35 threads on bolt 16
36 rollers on wall 10 riding on sled 14
38 spacer bolt between frames 42 of mutiple walls 40
40 multible walls
42 multiple frames
44 yieldable spacer sleeve about 38
46 nut on bolt 38
48 sleds of walls 40

Although this invention has been described in detail, such description is intended as being illustrative rather than limiting, since the invention may be variously embodied.

Having thus set forth and disclosed the nature of this invention, what is claimed is:

1. A soccer game training device comprising a horizontal sled means, a vertical frame ridigly secured on said sled means, a wall, means for yiedably securing said wall on said frame and said sled means comprising roller means mounted on the bottom of said yiedable wall and riding on said sled means, ball socket means secured to the back of said wall, threaded bolt means having ball head means movably mounted in said socket means, said bolt means extending through apertures in said vertical frame, compressible spring means about said bolt means between said socket means and said vertical frame, and nut means on said threaded bolt means beyond said frame adjustably compressing said spring means, whereby said wall may deflect under the impact of a moving soccer ball to retrieve the soccer ball at a different velocity.

2. The soccer training device of claim 1 and a second similar soccer training device and separate sled means in side by side relationship, yieldable interconnecting bolt means yieldably securing said soccer devices together in said by side relationship, and yieldably spacing sleeve means about said interconnecting bolt means.

* * * * *